US006091828A

United States Patent [19]

Akino et al.

[11] Patent Number: 6,091,828

[45] **Date of Patent: *Jul. 18, 2000**

[54] DYNAMIC MICROPHONE

[75] Inventors: Hiroshi Akino, Sagamihara; Shioto Okita, Kawasaki, both of Japan

[73] Assignee: Kabushiki Kaisha Audio-Technica

[ * ] Notice: This patent issued on a continued prosecution application filed under 37 CFR 1.53(d), and is subject to the twenty year patent term provisions of 35 U.S.C. 154(a)(2).

[21] Appl. No.: 09/126,466

[22] Filed: Jul. 30, 1998

[30] Foreign Application Priority Data

Dec. 26, 1997 [JP] Japan ..... 9-369525

[51] Int. Cl.[7] ..... H04R 25/00

[52] U.S. Cl. ..... 381/355; 381/357; 381/361; 381/170; 381/177; 381/182

[58] Field of Search ..... 381/355, 356, 381/357, 358, 360, 361, 369, 170, 177, 182, 94

[56] References Cited

U.S. PATENT DOCUMENTS

| | | | |
|---|---|---|---|
| 2,848,561 | 8/1958 | Gorike | 381/355 |
| 3,459,902 | 8/1969 | Warning | 381/357 |
| 3,995,124 | 11/1976 | Gabr | 381/361 |
| 4,427,845 | 1/1984 | Yoshida | 381/94 |

*Primary Examiner*—Curtis A. Kuntz
*Assistant Examiner*—Dionne N. Harvey
*Attorney, Agent, or Firm*—Welsh & Katz, Ltd.

[57] ABSTRACT

A vibration detecting unit is arranged in an air chamber in communication with a microphone unit and changes in pressure in the air chamber caused by the vibrations of a diaphragm of the vibration detecting unit is transmitted to the back surface side of a diaphragm of the microphone unit thereby suppressing the displacement of the diaphragm caused by external vibrations.

12 Claims, 5 Drawing Sheets

DYNAMIC MICROPHONE

FIELD OF THE INVENTION

The present invention relates to a dynamic microphone that can reduce vibration noise.

PRIOR ART

A microphone unit housed in a microphone case comprises a vibration section that includes a diaphragm and is supported to allow it to be vibrated with respect to the microphone case and a fixed section including a magnetic circuit, etc. fixed to the microphone case. In such a microphone, particularly a hand-held microphone, vibration noise produced by vibrations of the microphone case often raises a problem.

The cause is explained as follows: the electrical output of a microphone by sound waves depends on the relative displacement or the relative velocity between the vibration section and the fixed section and the relative displacement or the relative velocity is produced by vibrations of the microphone case and is taken out as vibration noise. That is, vibration noise is produced when the microphone case is displaced in a certain direction and then the mass of the vibration section returns to its original position.

The condenser microphone is a representative example of a microphone wherein the electrical signal output by sound waves is obtained by the relative displacement between the vibration section and the fixed section. The dynamic microphone is a representative example of a microphone wherein the electrical signal output by sound waves is obtained by the relative velocity. When the control systems (mass control, resistance control, and resiliency control) of microphones are taken into consideration, generally the loudness of vibration noise is in the order of directional dynamic microphones>non-directional dynamic microphones>non-directional condenser microphones.

In the case of uni-directional dynamic microphones out of hand-held microphones, particularly, handling noise is a problem. In the case of uni-directional dynamic microphones, since the bass collecting limit is situated in the resonance frequency zone of the vibration system, the problem becomes noticeable particularly when they are used for sound reinforcement.

The handling noise can be classified roughly into two. One is vibration noise of a low frequency component, such as "pop, pop," that is generated when the microphone is tapped with one of the fingers holding the microphone and the other is vibration noise of a relatively high frequency component, such as "rustling noise," that is generated when the microphone is rubbed. The vibration noise of the low frequency noise component has a directivity of cos θ with the vibration axis of the diaphragm. On the other hand, the vibration noise of the relatively high frequency component does not have any specific directivity because it is generated by a solid propagation in the course of the microphone→the resilient support member→the diaphragm.

To reduce such handling noise, conventionally the following methods are known.

(1) A method wherein the mass of the vibration system, particularly, the mass of the voice coil is made small.

(2) A so-called shock mount method wherein an viscoelastic material, such as rubber, is used for vibration insulation when a microphone unit is mounted in a microphone case (e.g., Japanese Patent Laid-Open No. 197000/1989).

(3) A method wherein in addition to a microphone unit a vibration detecting unit for detecting only vibration noise is mounted so that the output signals of both units are canceled with one another (e.g., U.S. Pat. No. 2,835,735).

(4) A method wherein a fixed section (magnetic circuit section side) is supported resiliently in a microphone unit case and the relative velocity (or relative displacement) between the fixed section and a vibration section is reduced (e.g., Japanese Patent Publication No. 9279/1982).

However, these prior techniques have the following defects.

In the method (1), since the source of vibration noise is made small, it is effective to reduce its noise, but the method is not practical in view of the strength of the material of the voice coil and the like.

The vibration insulation effect by the shock mount method (2) depends on the resonance frequency and the resonance sharpness of the vibration system. Therefore, the effect of reducing vibration noise is only expected in the frequency zone having at least a frequency mutually related to its resonance frequency. Further, in the case wherein the solid propagation noise is loud, the vibration insulation effect cannot be exhibited for a high frequency component.

In the output signal cancellation method (3), a microphone unit for collecting sound waves and a vibration detecting unit having the same converting system as that of the microphone unit are used to adjust and subtract the levels and the phases of the output signals of both units, so that vibration noise is reduced to a certain extent favorably.

However, to make both output signals of the microphone unit and the vibration detecting unit the same throughout a wide frequency zone not only requires a quite precise adjustment but also is difficult in practice. Therefore, it is required to restrict the frequency zone subject to the reduction of vibrations to a suitable range and to use subsidiarily, for example, the shock mount method in addition for a frequency zone outside it.

Further, the vibration detecting unit is provided with an enclosure to prevent sound waves from entering. That is, since the vibration detecting unit detects vibrations in an enclosed space, the resonance frequency of the diaphragm is increased, resulting in a drop in the output signal level.

Further, the microphone unit is placed in a free space and the vibration detecting unit is placed in a closed space. Since the units are placed in different environments, the operation for adjusting the alignment of the levels and the phases of the output signals of the units for temperature and the like is made difficult.

In the method (4), a fixed section is supported resiliently in a microphone unit case and the vibration section and the fixed section are vibrated in the same direction for the vibrations of the microphone unit case. This prevents vibration noise without generating a relative velocity between the voice coil and the magnetic circuit.

However, since an end of the diaphragm is directly fixed to the microphone unit case, it is difficult to reduce handling noise, such as "rustling noise" due to a high frequency component by solid propagation. Therefore, generally, a noise reducing means, such as the shock mount method, is employed subsidiarily.

Further, in Japanese Patent Publication No. 9279/1982, since consideration for a necessary acoustic circuit element for the operation as a dynamic microphone is not paid, a relative velocity difference at a high frequency is produced between the diaphragm and the resiliently supported magnetic circuit and therefore the reduction in vibration noise in a high frequency range is not expected. That is, among dynamic microphones, non-directional dynamic microphones are of resistance control and uni-directional dynamic microphones use a control system close to mass control. Generally, in microphones, to obtain a good directivity frequency response characteristic, it is required to connect closely a diaphragm and an acoustic impedance for controlling it. Thus, unless the impedance is reflected in a mechanical equivalent circuit of the driving system, vibration noise cannot be reduced in a wide frequency range. In particular, at a high frequency far from the resonance frequency, a relative velocity difference will appear conspicuously between the diaphragm and the resiliently supported magnetic circuit.

SUMMARY OF THE INVENTION

An object of the present invention is to provide a dynamic microphone that has a simple structure and can reduce vibration noise favorably in a wide frequency range without requiring a complicated adjusting operation.

The dynamic microphone according to the present invention comprises: a microphone case; a microphone unit that is attached to the upper end of said microphone case and is composed of a first magnetic circuit section formed with a first magnetic gap, a first voice coil arranged in said first magnetic gap, and a first diaphragm attached to an end of said first voice coil; an air chamber having a prescribed volume that is provided in said microphone case and is in communication with the back surface side of said first diaphragm; a vibration detecting unit that is arranged in said air chamber, is connected to said microphone unit, and is composed of a second magnetic circuit section formed with a second magnetic gap, a second voice coil arranged in said second magnetic gap, and a second diaphragm to whose end said second voice coil is attached; and vibration noise reducing means that adds, to the output signal of said microphone unit, the output signal from said vibration detecting unit whose phase is inverted in relation to the output of said microphone unit and causes changes in pressure in said air chamber produced by vibrations of said second diaphragm to act on the back surface side of said first diaphragm.

In this case, as the diaphragm of the vibration detecting unit, a metal plate (e.g., a brass plate) having a prescribed weight is preferably used in order to secure the signal output by the vibrations of the diaphragm as well as to cause changes in pressure in the air chamber (acoustic capacity) to be produced positively.

According to the present invention, since the vibration detecting unit is arranged in the air chamber that acts as an acoustic element and is in communication with the microphone unit and changes in pressure in said air chamber by the vibrations of its diaphragm are transferred to the back surface side of the microphone unit, the displacement of the diaphragm by the vibrations is suppressed.

Further, since the vibration detecting unit is placed not in a closed space like the conventional case but under approximately the same environment as that of the microphone, the materials of the vibration systems of both units can be made the same and no level difference and phase difference between the output signals of both units occur even if there is a change in environment, such as temperature and humidity. Therefore, without requiring a difficult adjusting operation, vibration noise can be reduced.

BRIEF DESCRIPTION OF THE DRAWINGS

FIG. 5(*b*) shows a graph of the acceleration/output level properties actually measured with the vibration detecting unit itself.

FIG. 6(*b*) shows a composite graph of FIGS. 5(*a*), 5(*b*) and FIG. 6(*a*).

DESCRIPTION OF THE PREFERRED EMBODIMENT

Figure 1:
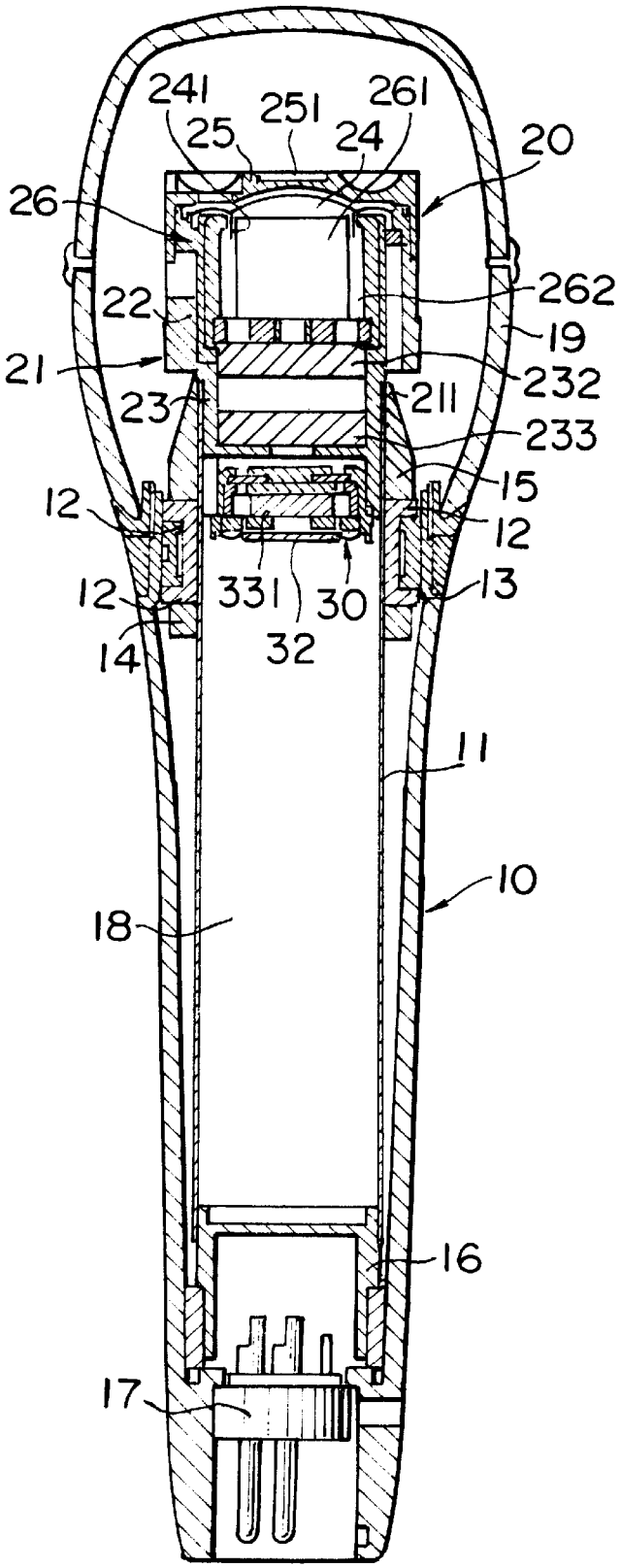
FIG. 1 is a cross-sectional view showing the whole constitution of the uni-directional dynamic microphone according to a first embodiment of the present invention.

Now, with reference to the drawings, an embodiment of the present invention is described. First, referring to FIGS. 1 and 2, the constitution of the uni-directional dynamic microphone according to the embodiment of the present invention is described.

The dynamic microphone in this embodiment is provided with a cylindrical microphone case 10 made of a metal, such as aluminum. In this microphone case 10, a cylindrical middle cylinder 11 is supported coaxially through a shock mount 12. This shock mount 12 is made, for example, of a viscoelastic rubber and a support ring 13 for the middle cylinder 11 is provided around the outer circumference of the shock mount 12. In passing, in FIG. 1, a stopper ring 14 is attached at a lower position of the shock mount 12 of the middle cylinder 11 and a reinforcing ring 15 is fitted at an upper position of the shock mount 12 of the middle cylinder 11.

A microphone unit 20 for collecting sound waves is attached to one end (the upper end in FIG. 1) of the middle cylinder 11. The other end of the middle cylinder 11 is closed by a bottomed cylindrical spacer cylinder 16, so that the inside of the middle cylinder 11 serves as an air chamber (acoustic capacity) 18 having a prescribed volume in communication with the microphone unit 20.

In passing, the other end of the middle cylinder 11 is supported at the lower end side of the microphone case 10 through the spacer cylinder 16. The lower end of the microphone case 10 is provided with an output connector 17. The upper end of the microphone case 10 is provided with a window screen 19 for covering the microphone unit 20.

The microphone unit 20 is provided with a cylindrical unit case 21. In this embodiment, the unit case 21 has a large-diameter main cylindrical section 22 and a smalldiameter secondary cylindrical section 23 connected to the lower part of the main cylindrical section 22. An opening section of the main cylindrical section 22 is provided with a diaphragm 24 having a voice coil 241. Further, to the opening section of the main cylindrical section 22 is attached a resonator 25 having a front acoustic terminal 251 to cover the diaphragm 24.

A magnetic circuit 26 is provided in the main cylindrical section 22. The magnetic circuit 26 is provided with a columnar magnet 261 vertically magnetized in FIG. 1, a cylindrical side yoke 262 concentrically arranged around the magnet 261, and a tail yoke 263 for connecting the side yoke 262 to one pole of the magnet 261. A magnetic gap G is formed between the magnet 261 and the side yoke 262 and the voice coil 241 of the diaphragm 24 is arranged in the magnetic gap G.

In this embodiment, a rear acoustic terminal 211 is provided at a stepped section between the main cylindrical section 22 and the secondary cylindrical section 23 and is in communication with a back side space of the diaphragm 24 through an air passage 212 formed in the main cylindrical section 22. Incidentally, a prescribed acoustic resistance member 213 is provided in the air passage 212.

The secondary cylindrical section 23 is in communication with the inside of the main cylindrical section 22, that is, the back side space of the diaphragm 24 through air holes 264 formed in the tail yoke 263. A bottom section 230 of the secondary cylindrical section 23 is formed with an air hole 231 in communication with the air chamber 18 in the microphone case 10. Acoustic resistance members 232 and 233 are provided in the secondary cylindrical section 23 on the side of the tail yoke 263 and on the side of the bottom section 230 respectively.

The secondary cylindrical section 23 is fitted and supported at one end of the middle cylinder 11, a sleeve 234 is connected to the secondary cylindrical section 23 on the side of the bottom section 230, and a vibration detecting unit 30 is attached to the sleeve 234.

The vibration detecting unit 30 is provided with a bottomed cylindrical unit case 31 fitted and supported in the sleeve 234. Herein, the unit case 31 is fitted and supported in the sleeve 234 with its bottom section 311 opposed to the bottom section 320 of the secondary cylindrical section 23. Therefore, the opening section of the unit case 31 is directed downward in FIGS. 1 and 2.

The opening section of the unit case 31 is provided with a diaphragm 32 having a voice coil 321 through a corrugation 322, a thin plastic plate, such that the diaphragm 32 can be vibrated. In this case, as the diaphragm 32, for example, a brass plate having a thickness of 0.8 mm and a diameter of about 10 mm is used, thereby securing the signal output by vibrations and making changes in pressure produce positively in the air chamber 18.

A magnetic circuit 33 is housed in the unit case 31. Similarly to the magnetic circuit 26 of the microphone unit 20, this magnetic circuit 33 is provided with a vertically magnetized columnar magnet 331, a cylindrical side yoke 332 arranged concentrically around the magnet 261, and a tail yoke 333 for connecting the side yoke 332 to one pole of the magnet 331. In this case, the magnet 331 is provided with an annular center pole piece 334 and a ring yoke 335 is provided to oppose the annular center pole piece 334 on the side of the side yoke 332 so that a magnetic gap G may be formed between them. The voice coil 321 of the diaphragm 32 is arranged in the magnetic gap G.

A plurality of air holes 336 are formed in the tail yoke 33 and each of the air holes 336 is provided with an acoustic resistance member 337. A part of the sleeve 234 is formed with an opening 235, for example, in the shape of a slit.

This vibration detecting unit 30 is housed in the air chamber 18 of the middle cylinder 11 with the vibration detecting unit 30 fitted and supported in the sleeve 234 and as is shown by the arrow A the middle cylinder 11 is in communication with the space on the back side of the diaphragm 24 through the opening 235 of the sleeve 234, the air hole 336 of the secondary cylindrical section 23, and the air holes 264 of the tail yoke 263.

Figure 3:
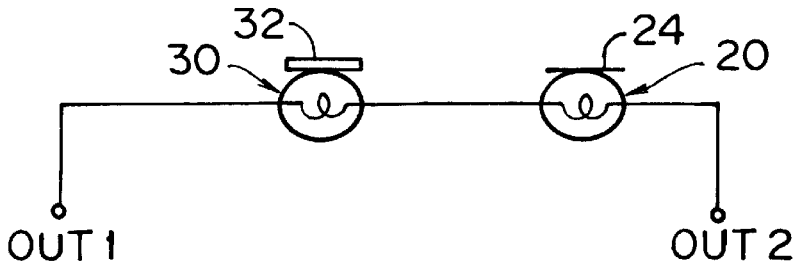
FIG. 3 is a connection diagram exemplifying the electrically connected state of the microphone unit and the vibration detecting unit according to the above first embodiment.

As is shown in FIG. 3, the microphone unit 20 and the vibration detecting unit 30 are electrically connected in series between microphone unit terminals OUT1 and OUT2.

Figure 4:
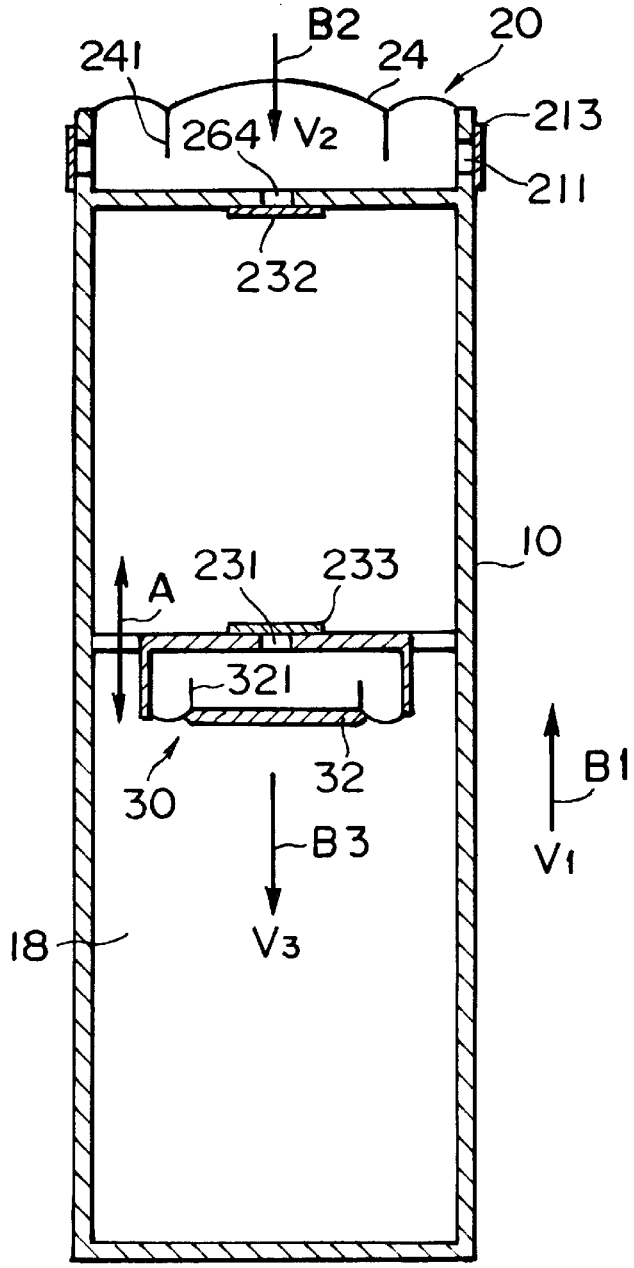
FIG. 4 is a schematic view that simplifies the inner structure to illustrate the action of the present invention.

Now, referring to FIG. 4, changes in pressure produced by vibrations of the diaphragm 32 of the vibration detecting unit 30 caused by external vibrations are described. Incidentally, since FIG. 4 is a schematic view for the illustration of the operation, the internal structure is simplified.

In FIG. 4, for example, when the microphone case 10 is driven at a vibration velocity of V1 in the direction of the upward arrow B1, the diaphragm 24 of the microphone unit 20 is vibrated relatively at a vibration velocity of V2 in the direction of the downward arrow B2. Further, similarly the diaphragm 32 of the vibration detecting unit 30 is vibrated relatively at a vibration velocity of V3 in the direction of the downward arrow B3.

Namely, when the microphone case 10 is displaced upward, both the diaphragm 24 of the microphone unit 20 and the diaphragm 32 of the vibration detecting unit 30 are relatively displaced downward. The downward displacement of the diaphragm 32 increases the pressure in the air chamber 18. The increased pressure acts on the back surface of the diaphragm 24 of the microphone unit 20 through the air passage of the arrow A shown above in FIG. 2 to push back the diaphragm 24 that is going to be displaced downward.

In contrast, when the microphone case 10 is displaced in the opposite direction, that is, in the downward direction, both the diaphragm 24 of the microphone unit 20 and the diaphragm 32 of the vibration detecting unit 30 are relatively displaced upward. This upward displacement of the diaphragm 32 decreases the pressure in the air chamber 18. The decreased pressure acts on the back surface of the diaphragm 24 of the microphone unit 20 through the air passage of the arrow A shown above in FIG. 2 to cause the diaphragm 24, which is going to be displaced upward, to remain at its original position.

In this way, the vibrations of the diaphragm 24 of the microphone unit 20 are suppressed to reduce vibration noise. In passing, although sound waves enter the back side of the diaphragm 24 from the rear acoustic terminal 211 of the microphone unit 20, the sound waves are absorbed or greatly attenuated by acoustic resistance members 232 and 233 in the secondary cylindrical section 23 and therefore the sound waves are not picked up by the vibration detecting unit 30.

As is described above, in response to external vibrations, both the diaphragm 24 of the microphone unit 20 and the diaphragm 32 of the vibration detecting unit 30 are inclined to be displaced in the same direction. Therefore, by reversing the directions of the magnetization of the magnets 261 and 331, the phase of the output signal of the microphone unit 20 and the phase of the output signal of the vibration detecting unit 30 becomes opposite to each other, so that vibration noise is also cancelled electrically. Further, by reversing the directions of the windings of the voice coils 241 and 321 to each other, the phases of both the output signals are reversed to each other.

By way of parenthesis, in the present invention, the vibration detecting unit 30 may have a simple structure like a microphone unit used, for example, in a close-talking microphone and it is possible to set suitably its voice coil, magnetic circuit, acoustic resistance member, etc., so that a close adjustment operation as in prior art is not required.

Figure 2:
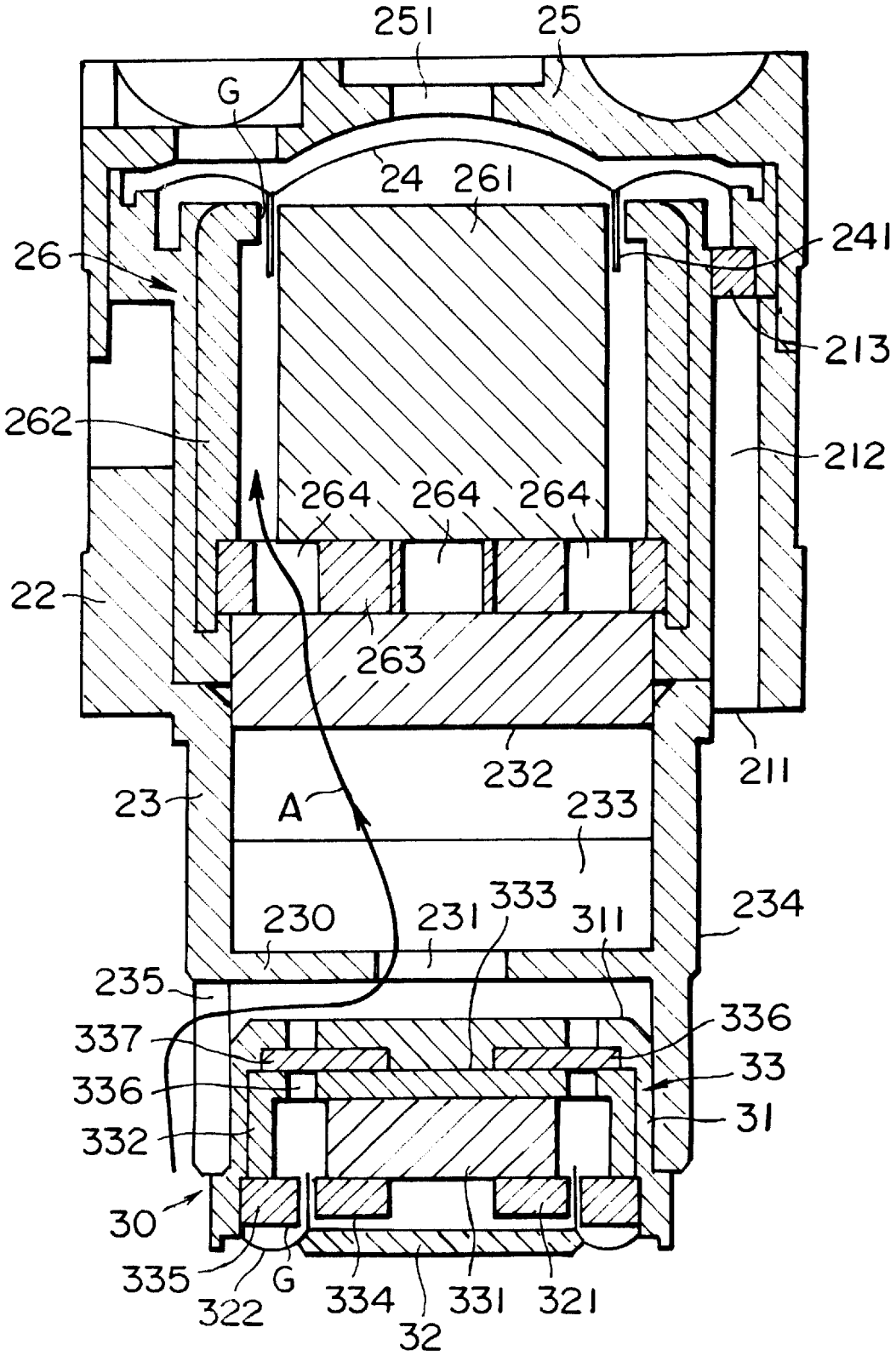
FIG. 2 is a cross-sectional view of an enlarged essential part of FIG. 1 according to the above first embodiment.
Figure 5A:
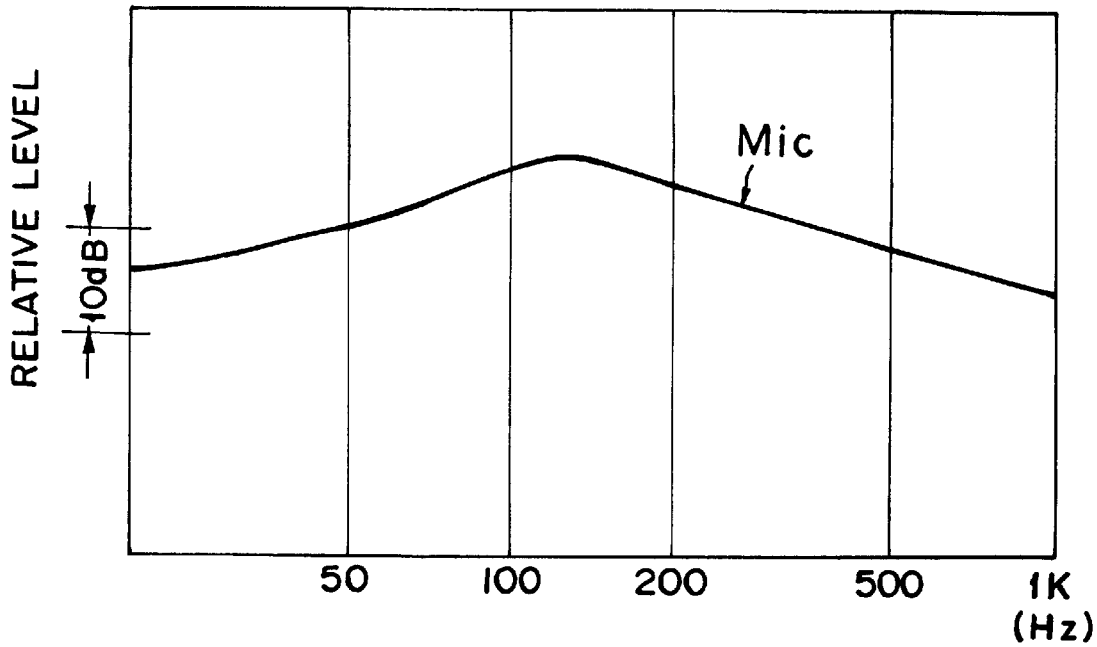
FIG. 5(*a*) shows a graph of the acceleration/output level properties actually measured with the microphone unit itself.
Figure 5B:
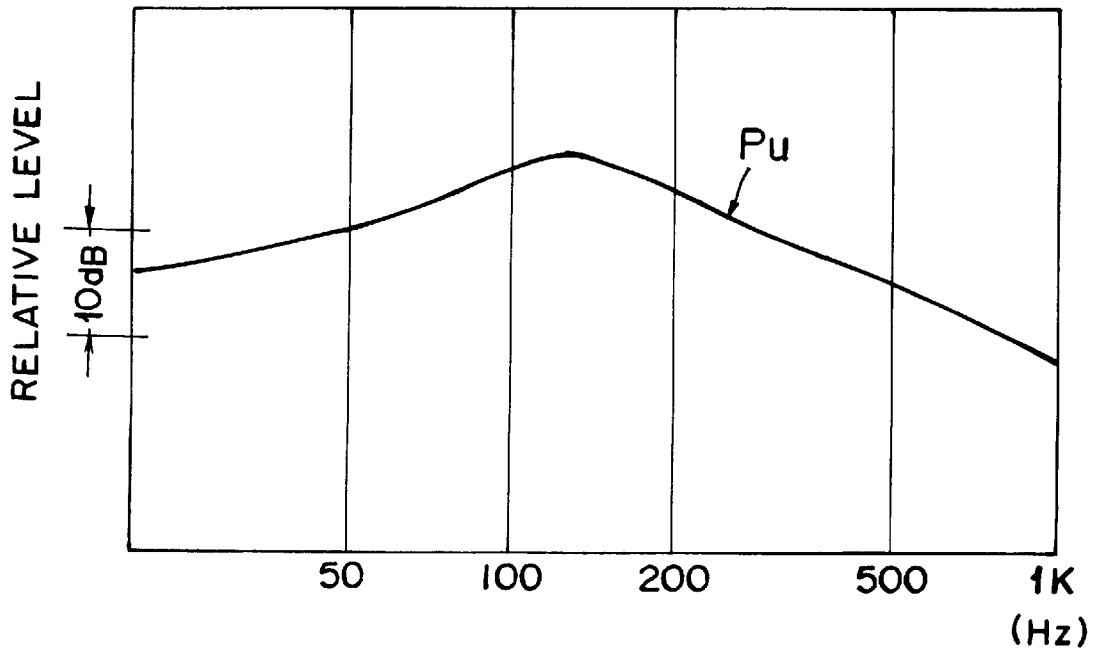

Now, to confirm the effect of the present invention of reducing vibration noise, the results of the measured acceleration/output level properties for a uni-directional dynamic microphone are shown in FIG. 5. The constitution of the microphone unit 20 and the vibration detecting unit 30 is as follows. In passing, in this case, to confirm only the effect of the vibration detecting unit 30, the shock mount 12 shown in FIG. 1 is removed.

(1) Constitution of the microphone unit 20

The diaphragm: the diameter was 22.5 mm.

The voice coil: the diameter was 14 mm, the weight was 40 mg, the material was CCAW (copper-clad aluminum wire), and the diameter of the wire was about 30 microns.

The impedance: 400 ohms.

(2) Constitution of the vibration detecting unit 30

The diaphragm: the diameter was 10.5 mm, the thickness was 0.8 mm, and the weight was 540 mg.

The brass voice coil: the diameter was 9.8 mm, the weight was 20 mg, and the diameter of the copper wire was about 30 microns.

The impedance: 150 ohms.

FIG. 5(*a*) is a graph of the measured acceleration/output level properties of the microphone unit (Mic) 20 itself and FIG. 5(*b*) is a graph of the measured acceleration/output level properties of the vibration detecting unit (Pu) 30 itself.

Figure 6A:
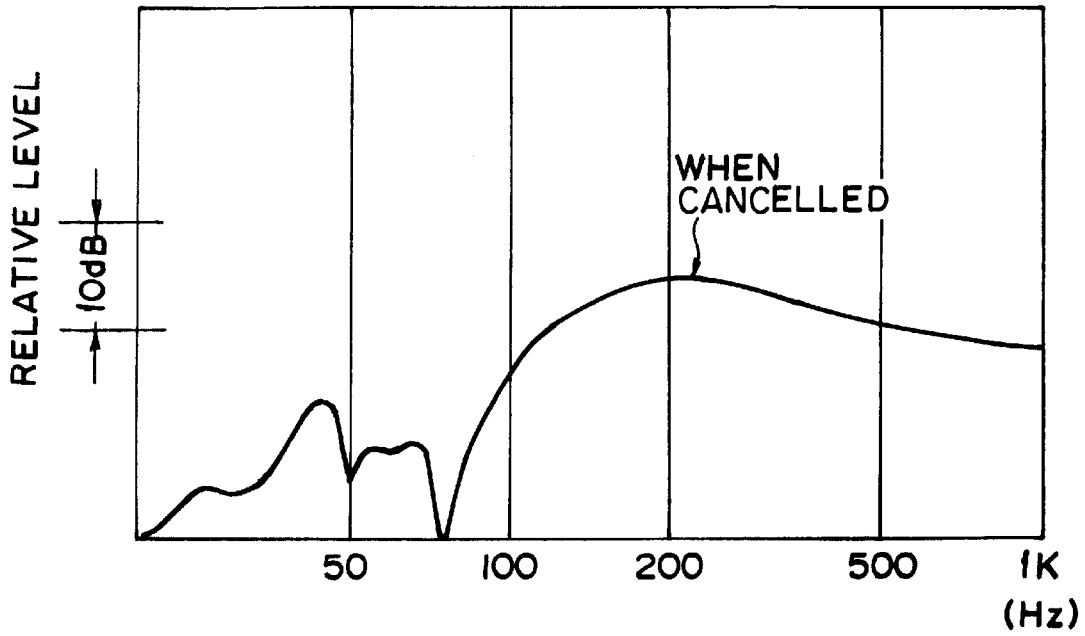
FIG. 6(*a*) shows a graph of the acceleration/output level properties actually measured with the outputs of the microphone unit and the vibration detecting unit canceled with each other.
Figure 6B:
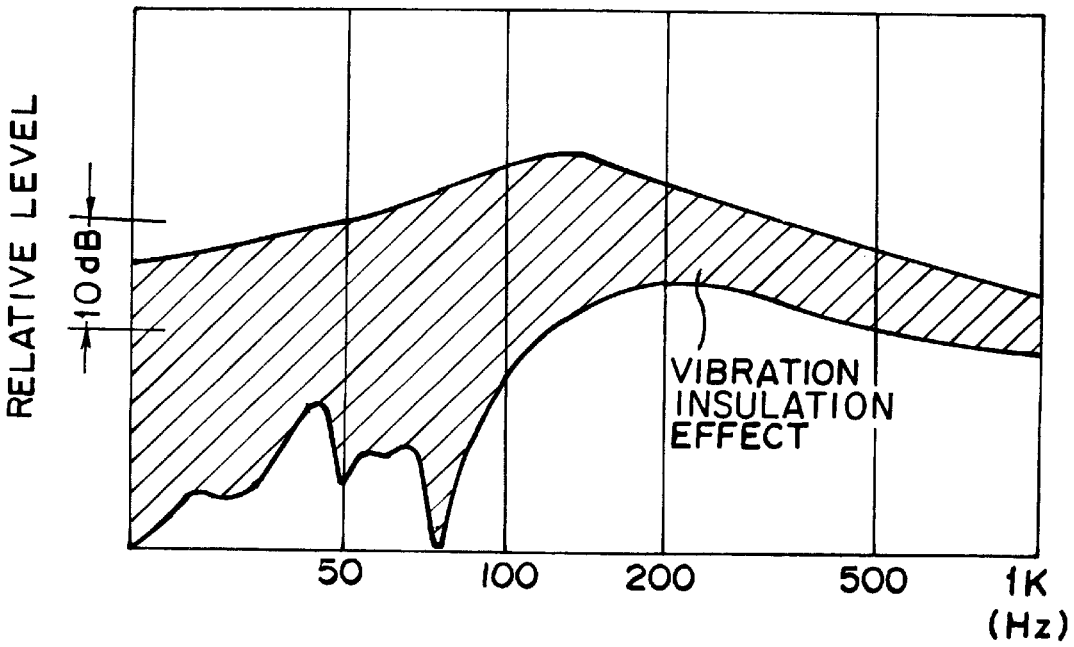

FIG. 6(*a*) is a graph of the cancelled result of the output signals of both units 20 and 30 according to the embodiment of the present invention and FIG. 6(*b*) is a composite graph of FIGS. 5(*a*), 5(*b*), and FIG. 6(*a*), wherein the shaded section indicates the extent of the vibration insulation effect.

As is apparent from the graph of the measurement of FIG. 6(*b*), according to the present invention, particularly in the low region that is the major component of vibration noise, the reduction effect was recognized. That is, in the region of about 100 Hz or less, the effect of reducing vibration noise is 20 dB (1/10) or more and in the region from over 100 Hz to about 1 kHz, the effect of reducing vibration noise is 6 dB (½) or more.

The present invention is not limited to the embodiment that is described above. For example, although, in the above embodiment, the middle cylinder 11 is provided in the microphone case 10 and the air chamber 18 is formed therein, the middle cylinder 11 can be omitted and the inside of the microphone case 10 may serve directly as an air chamber that is an acoustic capacity.

Further, in the above embodiment, the shock mount 12 is additionally used, but the shock mount 12 may be optionally used. Further, various modifications are possible without departing from the range of the technical idea of the present invention, for example, the position of the vibration detecting unit 30 may be changed to the central part of the air chamber 18 and in some cases the direction of the vibration detecting unit 30 may be changed to place the diaphragm 32 on the side of the microphone unit 20.

What is claimed is:

1. A dynamic microphone having a microphone case; a microphone unit having a first magnetic circuit having a first magnetic gap, a first diaphragm at an upper portion of said unit having a first voice coil for outputting acoustic signals therefrom; and a vibration detection unit having a second magnetic circuit with a second magnetic gap and a second diaphragm at a lower portion of said unit spaced from said first diaphragm with a voice coil, said dynamic microphone comprising:

a first housing having a main section for housing said microphone unit herein, and a secondary section smaller than said main cylindrical chamber, the first housing having a bottom at the end of the secondary section, and a sleeve extending from said bottom, the first housing being mounting to said microphone case, said first magnetic circuit having a first cylindrical magnet, a side yoke around said first cylindrical magnet, and a tail yoke under said first cylindrical magnet;

a spacer for forming an air chamber within said microphone case below said unit;

said vibration detection unit having a housing with a ceiling, and an opening at the lower end thereof, said second magnetic circuit having a second cylindrical magnet, a ring yoke under said second cylindrical magnet, a second side yoke around said ring yoke, and a top yoke on said cylindrical magnet; and a film under said second side yoke along said opening, the film having a semicylindrical cross section, said second diaphragm held by said film under said ring yoke, said vibration detection unit being mounted inside of said sleeve; and a pathway for allowing pressure transfer from said air chamber to said first magnetic gap through a first opening at said sleeve, a second opening at said bottom, and a third opening at said tail yoke.

2. The dynamic microphone defined in claim 1, wherein said first opening is a slit formed in said sleeve.

3. The dynamic microphone defined in claim 1, wherein said microphone unit has impedance of approximately 400 ohms, and said vibration detection unit has impedance of approximately 150 ohms, and wherein diameter, and thickness and weight of said second diaphragm is smaller, than said first diaphragm, respectively.

4. The dynamic microphone defined in claim 1, wherein said tail yoke has a plurality of apertures, and wherein an acoustic resistance member is disposed at the apertures of said tail yoke between the claiming of said second housing, and said tail yoke in said vibration detection unit.

5. The dynamic microphone defined in claim 1, and wherein when said first diaphragm in said microphone unit, and said second diaphragm in said vibration detection unit are displaced down by the upward displacement of said microphone case, the pressure in said air chamber is increased, and said first diaphragm in said microphone is returned, and wherein when said first diaphragm is said microphone unit, and said second diaphragm in said vibration detection unit are displaced up by downward displacement of said microphone case, the pressure in said air chamber is reduced, and said first diaphragm in said microphone is not deformed.

6. The dynamic microphone defined in claim 5, wherein the first magnetic circuit in the microphone unit has opposite polarity to the second magnetic circuit, and wherein the second magnetic circuit in said vibration detection unit outputs vibration detection signals into said air chamber in inverse phase relative to the acoustic signal of said first diaphragm.

7. A dynamic microphone having a microphone case; a microphone unit having a first magnetic circuit having a first magnetic gap, a first diaphragm having a first voice coil for outputting acoustic signals therefrom and a vibration detection unit having a second magnetic circuit with a second magnetic gap and a second diaphragm spaced from said first diaphragm with a voice coil, said dynamic microphone comprising:

a middle cylinder inside said microphone case;

a first housing having a main section for housing said microphone unit herein, and a secondary section smaller than said main cylindrical chamber, the first housing having a bottom at the end of the secondary section, and a sleeve extending from said bottom, the first housing being mounted to said middle cylinder, said first magnetic circuit having a first cylindrical magnet, a side yoke around said first cylindrical magnet cylindrical first magnet, and a tail yoke under said first cylindrical magnet;

a spacer for forming air chamber within said middle cylinder;

said vibration detection unit having a housing with a ceiling, and an opening at the lower end thereof, said second magnetic circuit having a second cylindrical magnet, a ring yoke under said second cylindrical magnet, a second side yoke around said ring yoke, and a top yoke on said second cylindrical magnet, and a film under said second side yoke along the inner edge of said opening, the film having a semi-cylindrical cross section, and said second diaphragm held by said film under said ring yoke; and a pathway passing from sad air chamber to said first magnetic gap through a first opening at said sleeve, a second opening at said bottom, and a third opening at said tail yoke.

8. The dynamic microphone defined in claim 7, wherein said first opening is a slit formed in said sleeve.

9. The dynamic microphone defined in claim 7, wherein said microphone unit has impedance of approximately 400 ohms, and said vibration detection unit has impedance of approximately 150 ohms, and wherein diameter, and thickness and weight of said swing plate is smaller than said first diaphragm, respectively.

10. The dynamic microphone defined in claim 7, wherein said tail yoke has a plurality of apertures, and wherein an acoustic resistance member is disposed at the apertures of said tail yoke between the ceiling of said second housing and said tail yoke in said vibration detection unit.

11. The dynamic microphone defined in claim 7, and wherein when said first diaphragm in said microphone unit, and said second diaphragm in said vibration detection unit are displaced down by the upward displacement of said microphone case, the pressure in said air chamber is increased, and said first diaphragm in said microphone is returned, and wherein when said first diaphragm in said microphone unit, and said second diaphragm in said vibration detection unit are displaced up by upward displacement of said microphone case, the pressure in said air chamber is reduced, and said first diaphragm in said microphone is not deformed.

12. The dynamic microphone defined in claim 11, wherein the first magnetic circuit in the microphone unit has opposite polarity to the second magnetic circuit, and wherein the second magnetic circuit in said vibration detection unit outputs vibration detection signals into said air chamber in inverse phase relative to the acoustic signal of said first diaphragm.

* * * * *